US006095700A

United States Patent [19]

Negishi et al.

[11] Patent Number: 6,095,700

[45] Date of Patent: Aug. 1, 2000

[54] BATTERY OPERATED THERMAL PRINTER WITH MEANS TO OPTIMIZE BATTERY LIFE

[75] Inventors: Kiyoshi Negishi; Katsumi Kawamura; Katsuyoshi Suzuki; Hiroshi Orita; Minoru Suzuki, all of Tokyo, Japan

[73] Assignee: Asahi Kogaku Kogyo Kabushiki Kaisha, Tokyo, Japan

[21] Appl. No.: 08/895,814

[22] Filed: Jul. 17, 1997

Related U.S. Application Data

[63] Continuation of application No. 08/605,806, Feb. 23, 1996, abandoned, which is a continuation of application No. 08/332,148, Oct. 31, 1994, abandoned.

[30] Foreign Application Priority Data

Oct. 30, 1993 [JP] Japan ..... 5-294462

[51] Int. Cl.[7] ..... B41J 2/315

[52] U.S. Cl. ..... 400/120.02; 347/9; 347/192

[58] Field of Search ..... 400/120.05, 120.01, 400/120.2; 347/192, 9

[56] References Cited

U.S. PATENT DOCUMENTS

| | | | |
|---|---|---|---|
| 3,934,695 | 1/1976 | Kovalick | 400/120.12 |
| 4,113,391 | 9/1978 | Minowa | 400/120.12 |
| 4,543,588 | 9/1985 | Fukui | 347/192 |
| 4,857,959 | 8/1989 | Shimbo et al. | 355/276 |
| 5,182,583 | 1/1993 | Horigome et al. | 400/54 |
| 5,191,356 | 3/1993 | Shibamiya | 400/120.09 |
| 5,230,056 | 7/1993 | Hoshina | 364/707 |
| 5,524,993 | 6/1996 | Durst | 400/120.14 |
| 5,638,104 | 6/1997 | Suzuki et al. | 347/171 |
| 5,669,720 | 9/1997 | Negishi et al. | 400/120.05 |

*Primary Examiner*—Edgar Burr
*Assistant Examiner*—Charles H. Nolan, Jr.
*Attorney, Agent, or Firm*—Greenblum & Bernstein P.L.C.

[57] ABSTRACT

In a thermal printer having a plurality of thermal elements arranged in a line, voltage of a battery which is to be applied to the thermal elements is detected. Based on the detected voltage, the period of time during which the thermal elements are driven is determined.

12 Claims, 11 Drawing Sheets

BATTERY OPERATED THERMAL PRINTER WITH MEANS TO OPTIMIZE BATTERY LIFE

This application is a continuation of application Ser. No. 08/605,806, filed Feb. 23, 1996, which was a continuation of application Ser. No. 08/332,148, filed on Oct. 31, 1994, entitled THERMAL PRINTER, both now abandoned.

BACKGROUND OF THE INVENTION

The present invention relates to a thermal printer which forms a letter or character image on a thermosensitive sheet.

Conventionally, a thermal printer forms an image on a thermosensitive sheet by using a thermal head having a plurality of thermal elements which applies heat to the thermosensitive sheet. The thermosensitive layer on the thermosensitive sheet is heated and developed (colored) when a certain heat energy is applied. The darkness of the color depends on the quantity of the applied energy. More specifically, the darkness of the color is related to the density of the thermosensitive pigment in the thermosensitive layer, that undergoes a change in color when heat is applied to the thermosensitive sheet. However, in such a printer, if the voltage of the battery changes during a printing operation, the darkness of the print will not be uniform, and a poor quality printout will result.

Further, in such a printer, the voltage to be applied to the thermal elements is determined to be in a predetermined range. Thus, if a voltage out of the range is applied to the thermal elements, for example, through a connector for an external power source, then the print may be too dark or too light.

SUMMARY OF THE INVENTION

It is therefore an object of the present invention to provide a thermal printer which is capable of forming a character image having an even darkness, regardless of the voltage of the battery.

For the object, according to the invention, there is provided a thermal printer having a thermal head provided with a plurality of thermal elements arranged in line. The printer includes

- a battery;
- a driver for driving the thermal elements to generate heat by applying voltage from the battery to the thermal elements;
- a detector for detecting the voltage of the battery; and
- a controller for varying a period of time during which the thermal elements are applied with the voltage in accordance with the voltage detected by the detector.

According to another aspect of the invention, there is provided a method for controlling a thermal printer which has a thermal head provided with a plurality of thermal elements arranged in line. A voltage of a battery is applied to the thermal elements for driving the thermal elements to generate heat. This method includes the steps of:

- detecting the voltage of the battery; and
- determining, in accordance with the detected voltage, a period of time during which the thermal elements are applied with the voltage.

DESCRIPTION OF THE ACCOMPANYING DRAWINGS

DESCRIPTION OF THE EMBODIMENTS

Figure 1:
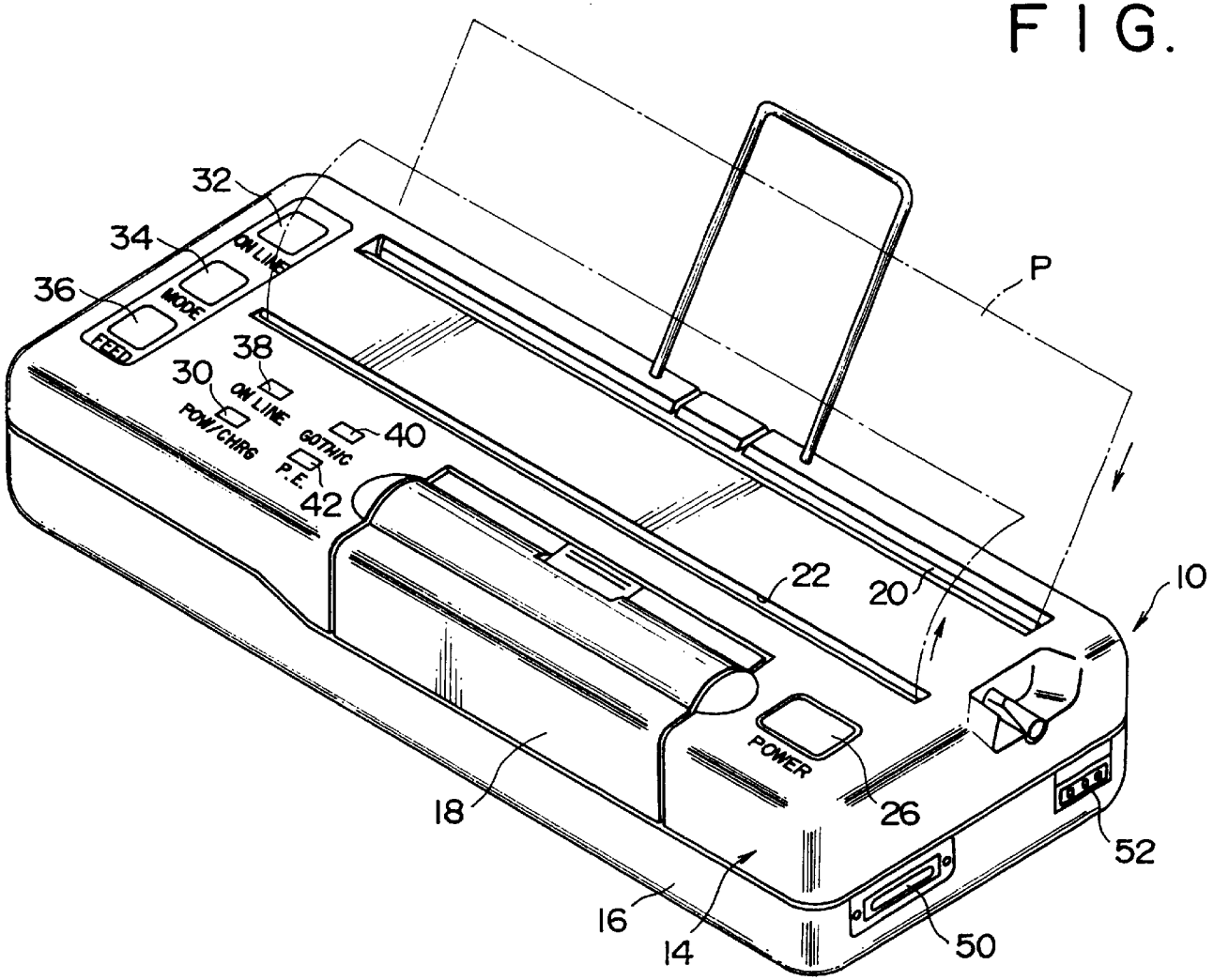
FIG. 1 is a perspective view of a thermal printer to which the invention is applied.

FIG. 1 is a perspective view of a thermal line printer 10 to which the present invent ion is applied.

As shown in FIG. 1, the thermal line printer 10 has an upper cover 14 and a lower housing 16 which are detachably coupled to each other. A battery cover 18 is provided on the upper cover 14 for covering a battery chamber where an internal nickel-cadmium battery 64 is mounted. On the upper surface of the upper cover 14, a sheet inlet opening 20 is formed. In this embodiment, an A5 size sheet P is inserted through the inlet opening 20. At the central portion of the upper cover 14, a sheet discharge opening 22 is defined.

A power switch 26 is provided on the right-hand side of the upper cover 14 (as shown in FIG. 1). By pressing the power switch 26, the printer 10 is toggled ON or OFF. When the thermal line printer 10 is ON, a power indicator 30 is lit. The power indicator 30 blinks when the available power from the internal battery 64 becomes low.

There are three buttons provided on the left-hand side area of the upper surface of the upper cover 14 (as shown in FIG. 1). These are an on-line button 32, a mode selection button 34 and a feed button 36.

The printer is toggled on-line or off-line by pressing the on-line button 32. When the printer is on-line, an on-line indicator 38 provided on the upper surface of the upper cover 14 is lit.

Pressing the mode selection button 34 toggles the font to be used for printing between "Gothic" and "Minchou" fonts. A font indicator 40 is provided on the upper surface of the upper member 12. When the Gothic font is selected, the font indicator 40 is lit, and when the Minchou font is selected, the font indicator 40 is not lit.

While the feed button 36 is pressed down, a sheet feed mechanism (not shown) is driven and the sheet P having been loaded in the thermal line printer 10 is fed and discharged. A paper out indicator 42 is provided on the upper cover 14, to indicate that there are no sheets loaded in the printer 10. The indicators 30, 48, 40 and 42 are LEDs (Light Emitting Diodes) in the present embodiment.

A communication connector 50 and a DC connector 52 are provided on the right-hand side surface of the lower housing 16. A printer cable is plugged into the communication connector 50 to connect the printer 10 with a host computer (not shown). Data to be printed is transmitted through the communication connector 50.

The DC connector 52 is a connector to which DC voltage is applied from an external device such as an AC to DC converter (hereinafter referred to as an AC adapter), when the external DC voltage source is used instead of the internal battery 64.

Figure 2:
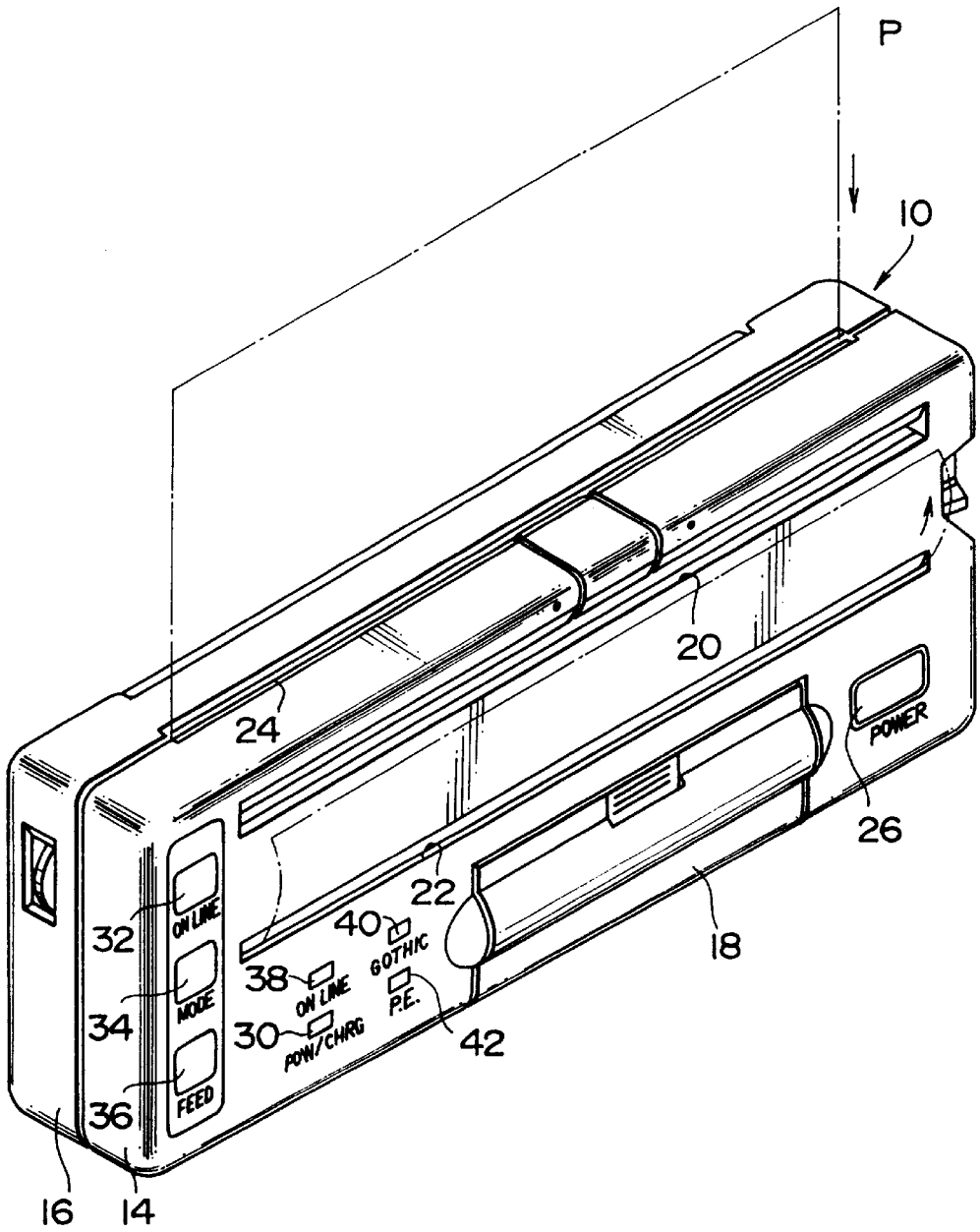
FIG. 2 is another perspective view of the thermal printer.

FIG. 2 is another perspective view of the thermal printer 10. As shown in FIG. 2, the thermal printer 10 has another sheet inlet opening 24. The sheet P can be inserted in the printer 10 either through the opening 20 or through the opening 24. In either case, the sheet P is discharged from the discharge opening 22.

Figure 3:
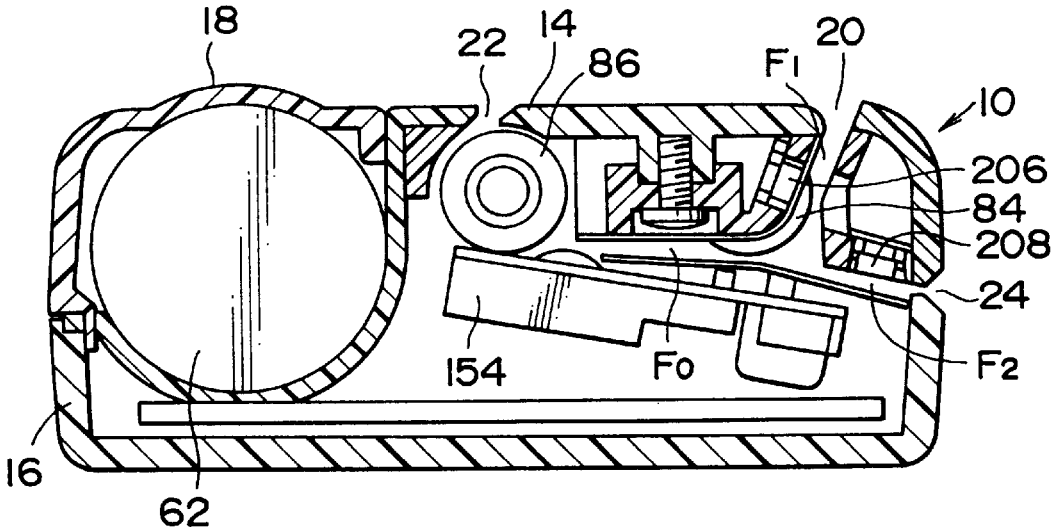
FIG. 3 is a cross sectional view of the thermal printer.

FIG. 3 is a cross-sectional view of the thermal printer 10. Inside the upper cover 14 and lower housing 16, a battery chamber 62 for accommodating the nickel-cadmium battery is formed. A platen roller 86 is rotatably supported by a frame member (not shown) at the right of the battery chamber 62 (as shown in FIG. 3). The platen roller 86 extends along a longitudinal direction (right and left direction in FIG. 1). A thermal head 154 is provided with a plurality of thermal elements arranged in line along the longitudinal direction. The thermal head 154 is biased towards the platen roller 86 so that the thermal elements forcibly contact the circumferential surface of the platen roller 86. The thermosensitive sheet P is introduced from the inlet opening 20 or 24, fed along a feed path F1 or F2, and then fed along a common feed path F0 by means of a feed roller 84. An image is printed line by line at a printing position where the thermal elements face the platen roller 86 by the linearly arranged thermal elements on the thermal head 154, while the sheet P is being fed by the platen roller 86. The sheet P is then fed by the platen roller 86 to be discharged out of the printer 10 through the discharge opening 22.

Figure 4:
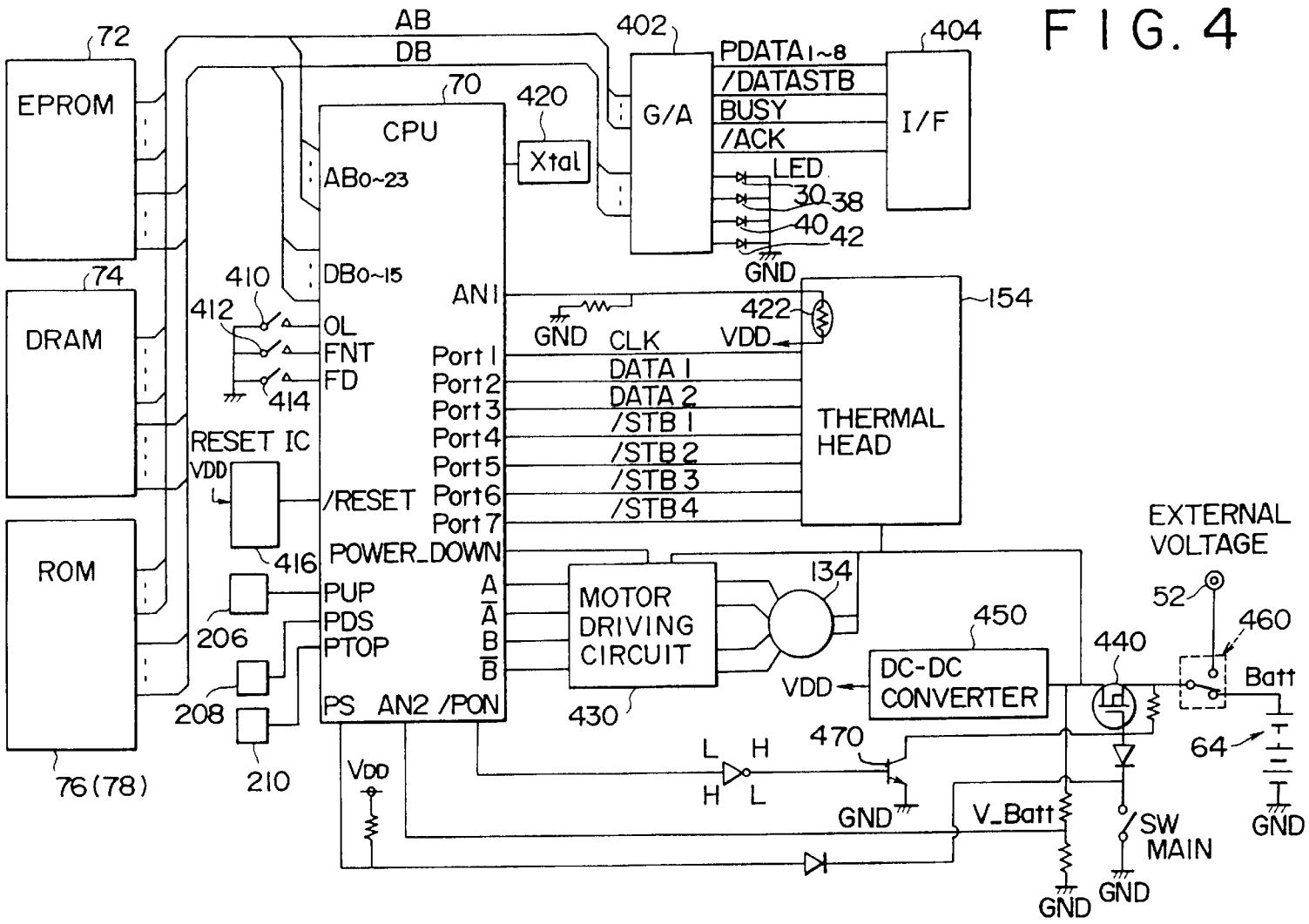
FIG. 4 is a block diagram illustrating a control system of the thermal printer.

FIG. 4 is a block diagram of a control system of the thermal line printer 10.

A microprocessor 70 is connected with an EPROM 72, DRAM 74, first font ROM 76, second font ROM 78, and gate array 402 through address ports AB0–AB23 and data ports DB0–DB15. The microprocessor 70 outputs address data to an address bus AB by way of the address ports AB0–AB23, and exchanges data through a data bus DB by way of the data ports DB0–DB15.

The EPROM 72 stores a program for controlling the performance of the printer 10, and initializing the operation of the printer 10. The DRAM 74 has an area where a bit map is developed, an area for storing data transmitted through an interface 404, and some other work areas. The printer 10 uses two types of fonts, "Gothic" and "Minchou", and font data thereof are stored in the ROM 76 and the ROM 78, respectively (only one ROM is shown in the drawing).

The microprocessor 70 uses the gate array 402 to exchange data through the interface 404, and drive the indicators 30, 38, 40, and 42.

The interface 404 is a printer interface and has eight data lines PDATA1 through 8 and three control lines /DATASTB, BUSY, and /ACK. The line /DATASTB initiates the inputting of data to the printer 10, the line BUSY indicates that the printer 10 cannot accept the print data, and the line /ACK acknowledges reception of the print data. Note that a low active signal, and lines and ports which exchange the low active signal are denoted with a mark "/" placed before a character string, throughout the specification.

The microprocessor 70 has three ports OL, FNT, and FD which monitor the state of switches 410, 412, and 414, respectively. The switch 410 is toggled ON or OFF with the operation of the on-line button 32. If the switch 410 is OFF, the printer 10 cannot receive the print data from the host computer. The switch 412 is toggled ON or OFF with the operation of the mode select button 34, in order to switch the font type to be used in the printing operation. The switch 141 is ON when the feed button 46 is held pressed down to feed the sheet P. The microprocessor 70 obtains the states of the switches 410, 412, and 414, and controls the operation of the printer 10 accordingly.

A divided voltage V_Batt of the internal battery 64 (or an external DC voltage) is applied to an analog port AN2. The microprocessor 70 A/D converts the applied analog voltage to a digital value, and detects the voltage of the battery 64 (or the external voltage source). A reset IC 416 is provided for directly detecting the voltage of the output of a DC—DC converter 450. IF the detected voltage is less than a predetermined voltage value, the reset IC 416 outputs a reset signal to a /RESET port of the microprocessor 70. For example, if the output of the DC—DC converter 450 becomes lower than the predetermined voltage value during the operation, or if the output of the DC—DC converter 450 does not exceed the predetermined voltage value when the printer 10 is turned ON, the microprocessor 70 is reset.

First and second sensors 206 and 208 are provided in the sheet feed paths F1 and F2, respectively, and detect the presence of a thermosensitive sheet P and output a sheet detection signal. A third sensor 210 which is provided on an upstream side of the thermal head 154 in the common path F0 also detects the presence of the sheet P and outputs a sheet detection signal. The output signals from the sensors 206, 208 and 210 are input to ports PUP, PDS, and PTOP, respectively, of the microprocessor 70. The microprocessor 70 detects the position of the sheet P inside the printer 10 by monitoring the input sheet detection signals.

A reference clock signal is generated by a crystal 420 and transmitted to the microprocessor 70. In accordance with the reference clock signal, the microprocessor 70 outputs a transfer clock CLK from a port Port1. Synchronously with the transfer clock CLK, print data bit-mapped in the DRAM 74 is transferred line by line to the thermal line head 154. The print data for one line is divided into two blocks of data DATA1 and DATA2, and transmitted from ports Port2 and Port3.

Heat radiated from each thermal element is controlled with strobe signals /STB1–/STB4 which are outputted from ports Port4 through Port7. Thus, DATA1 and DATA2 identify the thermal elements to be driven, and strobe signals /STB1–/STB4 drive the identified thermal elements to radiate the desired heat.

A thermistor 422 is provided on the thermal head 154 for detecting the temperature of the thermal head 154. The output of the thermistor 422 is input to a port AN1. The microprocessor 70 A/D converts the signal input to the port AN1, and detects the temperature of the thermal line head 154.

Signals for controlling the performance of a motor 134 are transmitted through ports A, /A, B, /B, and POWER_DOWN to a motor drive circuit 430.

A port /PON outputs a signal for turning ON or OFF a FET 440. Initially, when the power switch is depressed, current flows through the Gate-Source resistor, the FET 440 is turned ON, and voltage (14.4V) of the battery 64 is applied to a DC—DC converter 450. The DC—DC converter 450 outputs voltage used for driving the thermal head 154, the motor drive circuit 430, and other circuits. The DC—DC converter 450 also outputs a drive voltage VDD (5V) to drive the microprocessor 70, EPROM 72, DRAM 74, ROM 76, and ROM 78. When the circuit is operating the microprocessor 70 ties port /PON Low. Once the FET 440 is turned ON by depressing the main switch, the FET 440 is kept ON after the power switch is released. Thus, if the main switch is momentarily depressed when the printer is OFF, the FET 440 is turned ON and the status will be maintained until the main switch is depressed again.

When the main switch is again depressed, the microprocessor 70 detects that the port PS is tied Low momentarily, and makes /PON High. Transistor 470 is then turned OFF and the Gate is floating. Then, the FET 440 is turned OFF.

The thermal line printer 10 receives power from the internal Nickel-Cadmium battery 64, which outputs 14.4 VDC. Further, the printer 10 has the DC connector 52 to which an external voltage source such as an AC adapter for converting 100–120 VAC to 14.4 VDC can be connected. When the AC adapter is connected, a switch 460 is switched such that the internal battery 64 is disconnected from the control system, and the AC adapter is connected to the control system.

Figure 5:
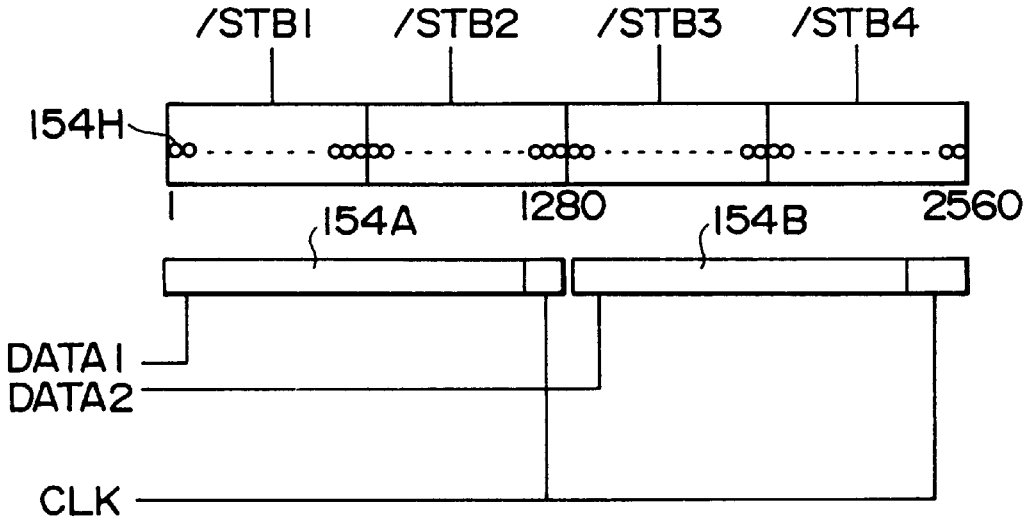
FIG. 5 is a diagram schematically illustrating the construction of the thermal head.

FIG. 5 is a diagram showing the construction of the thermal line head 154. The thermal line head has 2560 thermal elements 154H arranged in line. The thermal head 154 has two registers 154A and 154B. Print data for the first to 1280th elements is transferred to the register 154A as DATA1, and print data for the 1281st to 2560th elements is transferred to the register 154B as DATA2. Bits of the registers 154A and 154B correspond to the thermal elements 154H. As aforementioned, the data DATA1 and DATA2 are transferred as serial data from the microprocessor 70 to the registers 154A and 154B synchronously with the transfer clock CLK.

The thermal elements 154H are divided into four groups, respectively, driven with the strobe signals /STB1–/STB4, which have different phases. When each of the strobe signals /STB1–/STB4 is Low, the thermal elements 154H, print data for which are 1, and which corresponds to the Low strobe signal is driven to radiate heat.

Figure 6:
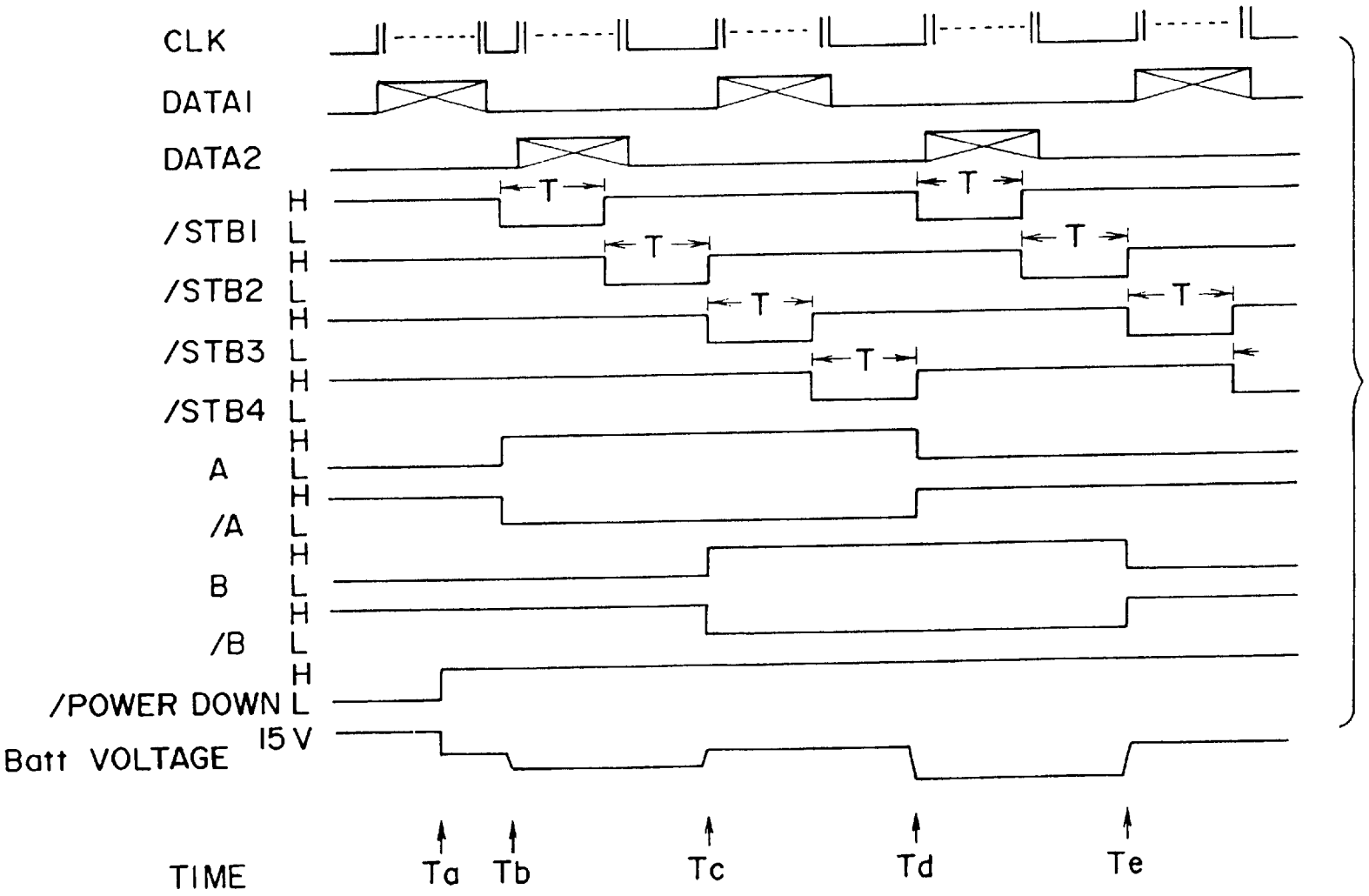
FIG. 6 is a timing chart showing the transmission of data, strobe pulses, and motor drive pulses.

FIG. 6 is a timing chart showing the timing of strobe signals and the motor driving signals. When 1280 bits of data is transmitted to the register 154A as the DATA1, /STB1 is set to Low for a predetermined period T to start printing. When the /STB1 is changed from Low to High, /STB2 is set to Low, and printing according to the data stored in the register 154A is completed. When the /STB1 becomes Low, transfer of the DATA2 (another 1280 bits of data) to the register 154B is initiated. When the /STB2 is changed from Low to High, since at that time, the DATA2 has been stored in the register 154B, the strobe /STB3 is changed from High to Low. Similarly, after the /STB3 is changed to High, the /STB4 is changed from High to Low, and the 2560 bits of data is printed, i.e., one line of image is printed. As described above, in the printer 10, printing according to the DATA1 starts immediately after the DATA1 is transferred to the register 154A, and the DATA2 is transferred to the register 154B while the printing of DATA1 is performed. Thus, DATA2 can be printed immediately after DATA1 has been printed.

In this embodiment, when DATA1 is transferred to the register 154A for the first time, data stored in the register 154B is ignored. Further, as long as one of the strobe signals is Low, even if the transfer clock CLK is transmitted to the thermal head, no data is written in the registers 154A and 154B. Thus, the data stored in the register 154A does not change while the DATA2 is transferred to the register 154B.

DATA1 for the succeeding line is transferred to the register 154A while printing for the DATA2 of the preceding line is performed, and the data transmission is repeated until the printing operation is completed.

When printing of one line has been completed, before the next strobe signal /STB1 is changed to Low, the voltage of the battery 64 is detected and checked. If the voltage becomes lower than a predetermined value, the indicator 30 blinks to warn. If the voltage of the battery 64 is lower than the minimum operable voltage, printing is terminated. Note that during printing, since current flows through the driven thermal elements 154H, the voltage of the battery 64 is lowered by voltage corresponding to the number of driven thermal elements 154H.

In this embodiment, in order to lower power consumption, phase current applied to the step motor 134 is lowered by changing the /POWER_DOWN signal to Low when printing is not performed (i.e., the sheet is not fed). In this embodiment, the regular phase current is 200 mA, and the lowered phase current is 10 mA. Thus, prior to the printing operation, the phase current should be raised form 10 mA to 200 mA by changing the /POWER_DOWN signal from Low to High. In the present embodiment, the step motor 134 is driven with use of a two-phase exciting method. Therefore, total current applied to the motor 134 changes from 20 mA to 400 mA, which lowers the voltage of the battery 64. The microprocessor 70 checks the voltage at this point in time, and if the voltage is lower than the minimum operative voltage, the microprocessor 70 instructs the indicator to blink, and stops the printing operation.

Before the printing operation, at Ta in FIG. 6, the /POWER_DOWN signal is changed to High as described above. Then at Tb, motor driving pulse signals A, /A, B and /B are applied. In the embodiments, a two-phase exciting method is used for driving the pulse motor 34. After Tb, the pattern of the states of the pulse signals A, /A, B, and /B are subsequently changed, such that two of the signals are High, and the others are Low. As driven like this, the current consumed for driving the motor 34 changes little during the printing operation. Thus, the voltage changes little due to the power consumption for driving the motor 134. Rather, depending on the number of the thermal elements, the voltage of the battery 64 fluctuates while the printing operation is executed as shown in FIG. 6, between time Tb–Te. The change of the voltage at Ta is due to the change of the /POWER_DOWN signal. The voltage of the battery is detected at Ta and when the pattern of the motor driving pulses is changed at Tb, Tc, . . . , etc.

As described before, in the embodiment, the thermal elements are divided into four blocks, and the thermal elements are driven block by block.

As aforementioned, the voltage of the battery 64 fluctuates as it is used. Thus, in the embodiment, heat generated by the thermal elements are adjusted.

The heat energy P generated by an element is calculated as follows.

$$P=V*V*R[W] \quad (1)$$

where, R is a resistance of an element, and V is the voltage of the battery. From the calculated energy P, a quantity of heat Q is calculated as follows.

$$Q=P*T[J] \quad (2)$$

where, P is the energy calculated as above, and T is a period of time during which a thermal element is driven. In the embodiment, in order to maintain Q at a constant value, a change of voltage V is compensated by changing the time period T.

Figure 7:
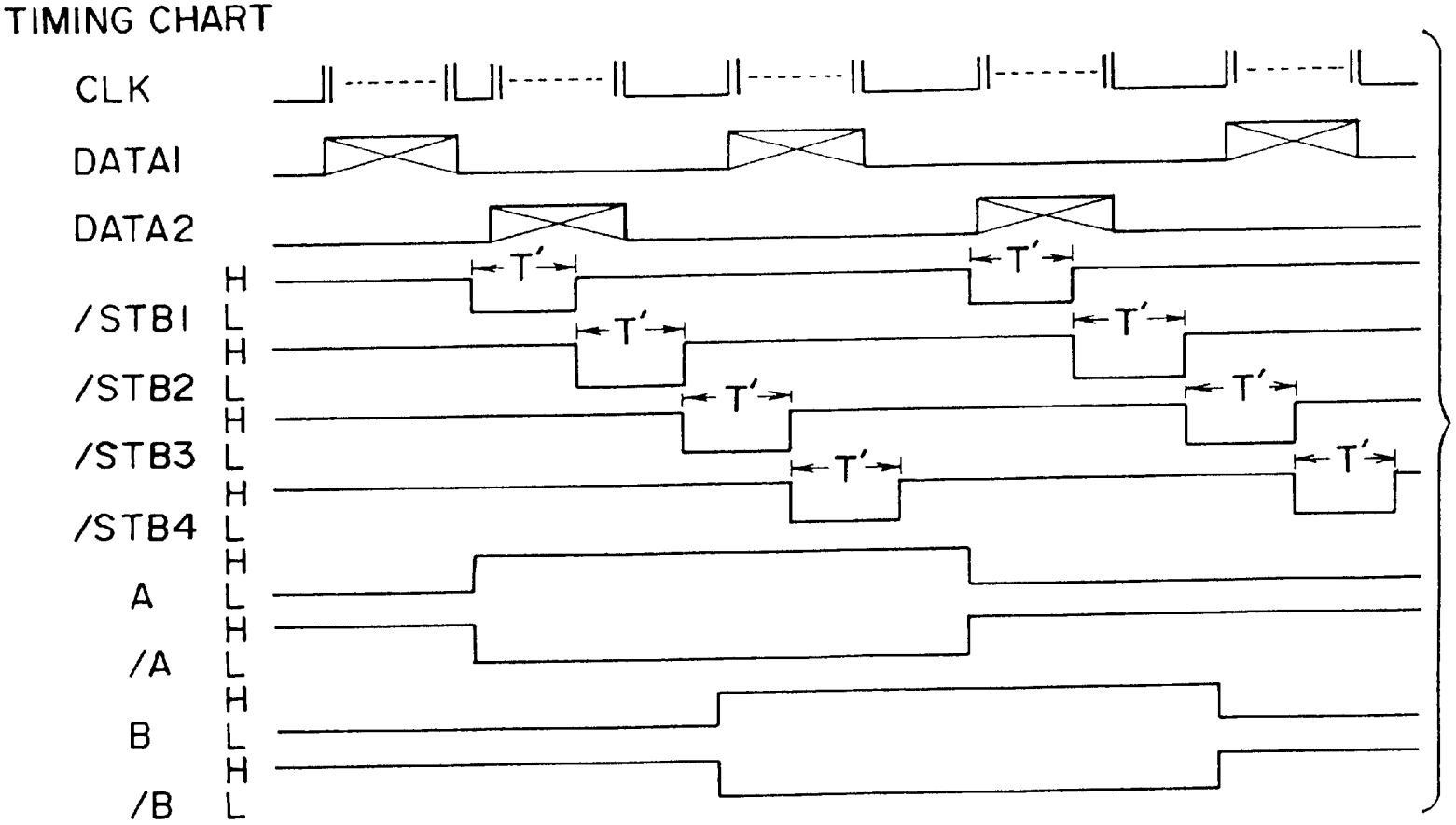
FIG. 7 is a timing chart showing the transmission of data, strobe pulses, and motor drive pulses when the voltage is relatively high.

In FIG. 6, the time period T is relatively long. In FIG. 7, the time period T' is shorter than the period of time T, while the period of the motor driving pulses are the same as in FIG. 6. In FIG. 7, /STB1 is not changed to Low immediately after /STB4 is changed from Low to High since the sheet has not yet fed by one line. After the sheet P is fed, strobe /STB1 is changed to Low. In other words, a series of strobe signals /STB1 through /STB4 are outputted synchronously with the feeding of the sheet P.

Figures 8, 8A:
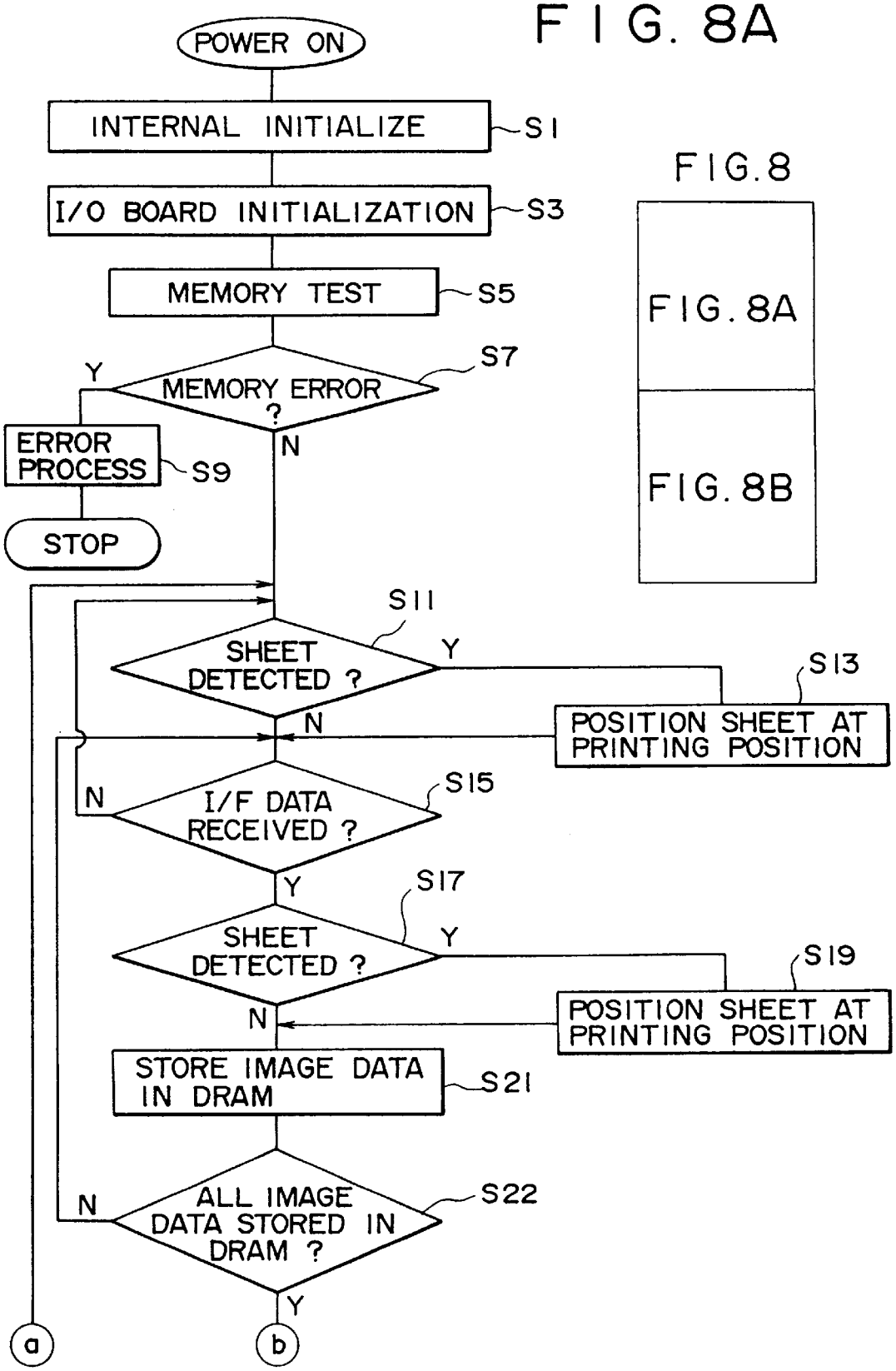
FIGS. 8, 8A and 8B show a flowchart illustrating a sequence of printing operations.
Figure 8B:
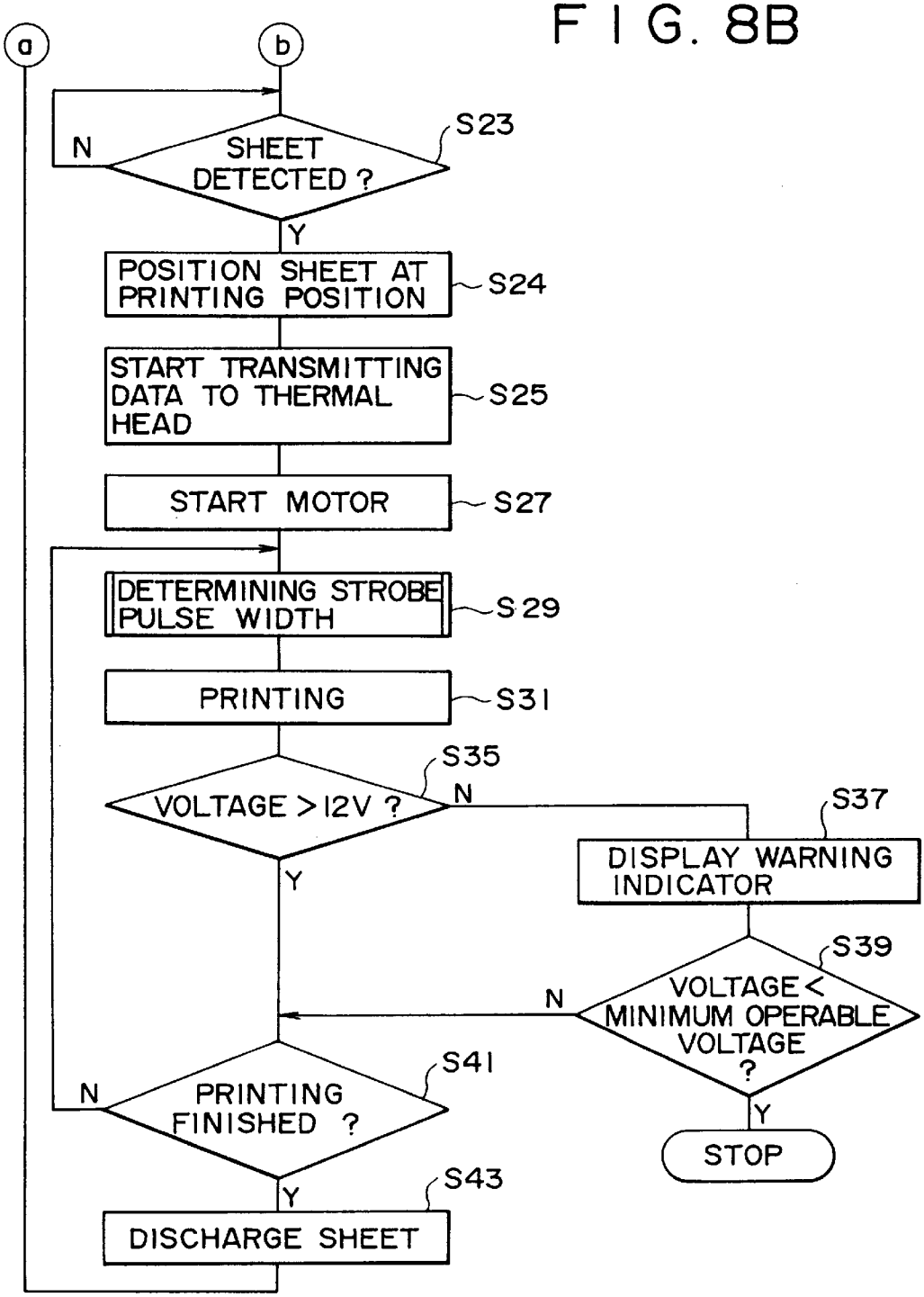
Figure 9:
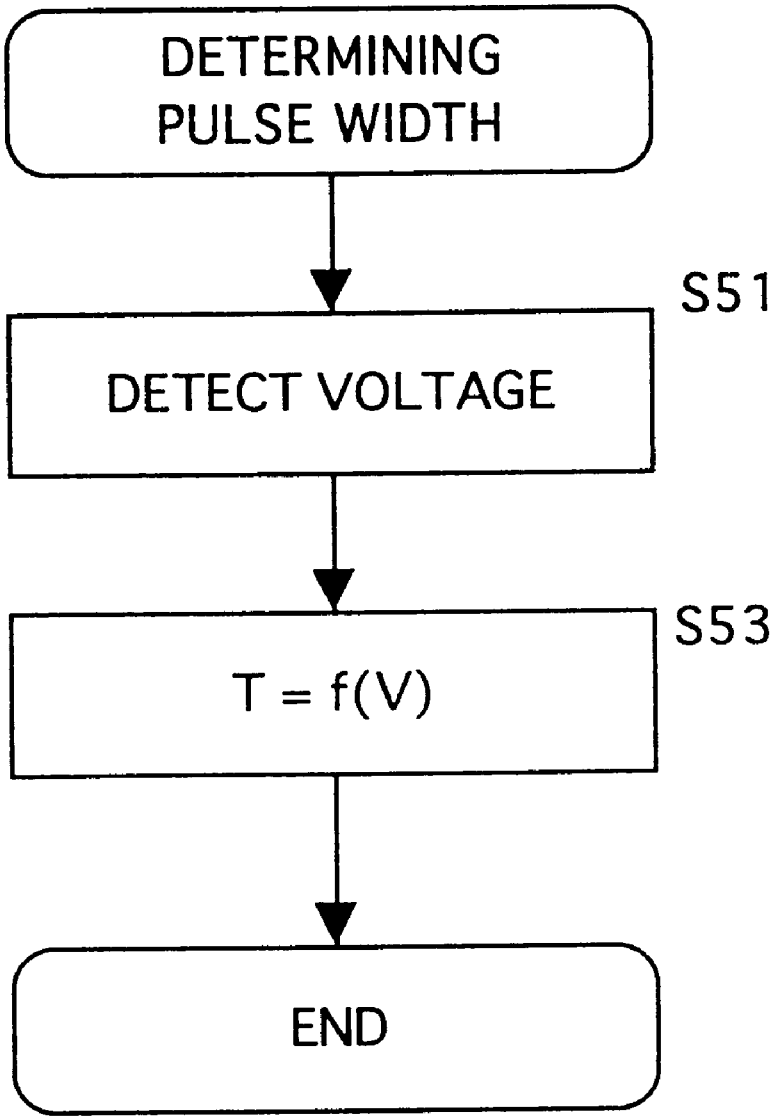
FIG. 9 is a flowchart showing a sequence where a width of the strobe pulse is determined.

FIGS. 8A and 8B, and FIG. 9 are flowcharts showing the operation of the above-described embodiment.

FIGS. 8A and 8B show a flowchart illustrating a control of a third embodiment according to the present invention.

As shown in FIGS. 8A and 8B, the printer is turned ON, then initialization and memory tests are performed in Steps S1 through S5. If errors are detected in DRAM 74 in Step S7, the printing operation is not performed, the error is indicated in Step S9, and the operation is terminated.

If no errors are detected in Step S7, control goes to Step S11. If the sensor 206 or 208 detects the presence of a sheet P, the sheet P is positioned at a printing position (Step S13). At Step S15, if data has not yet been received, Steps S11 and S15 are then repeated until data is received by the interface. In this embodiment, the sheet positioning process at Step S13 is executed for a first time when a sheet is detected, and will be skipped thereafter.

When data is received at the interface I/F (S15:YES), the presence of the sheet P is detected again in Step S17. If the sheet P is present, then sheet positioning is performed in Step S19 in a manner similar to that described in Step S13. Therefore, if the sheet has been positioned at the printing position, Step S19 is skipped.

The data received by the interface I/F is stored in the DRAM 74 in Step S21. The sequence of Steps S11 through S22 are repeated until the data corresponding to a page of the sheet P is stored in the DRAM 74. When all the data is stored in the DRAM 74 (S22:YES), the sheet P is detected in Step S23, and the positioning operation is executed in Step S24. This positioning operation is skipped if the sheet P has already been fed to the printing position in steps S13 or S19. Since the data has been stored in the DRAM 74, the data is converted to bit map data in the bit map area in the DRAM 74.

In Step S25, the microprocessor 70 starts transmitting bit map data DATA1 to the thermal head 154. When DATA1 has been transmitted, the motor 134 is driven in Step S27. In Step S29, the strobe pulse width is determined based on the voltage of the battery 64. Then, the thermal elements are driven in accordance with the determined strobe pulse width (Step S31).

If it is detected that the voltage of the battery is less than or equal to 12V in Step S35, a warning indication is made in Step S37. Further, if the voltage of the battery is less than a minimum operable voltage in Step S39, then the printing operation is terminated. If the voltage of the battery is greater than the minimum operable voltage, then the printing of the subsequent line is executed. When the printing operation is completed, the sheet P is discharged in Step S43, and the control goes to Step S11.

FIG. 9 shows a flowchart illustrating a sequence of determining the strobe pulse width.

In the flowchart, the voltage of the battery 64 is detected (Step S51), and based on the detected voltage, the strobe pulse width is determined as a function of the detected voltage (Step S53). From the equations (1) and (2), the function can be defined as:

$$T = Q / P \tag{3}$$
$$= Q / (V * V / R)$$

where, Q is a quantity of heat necessary for forming an image on the thermosensitive sheet, V is the voltage of the battery 64, and R is a resistance of a thermal element. This equation is a simplified one, and the actual equation can be provided by modifying the above equation in accordance with the structure of the printer, and the like.

Figure 10:
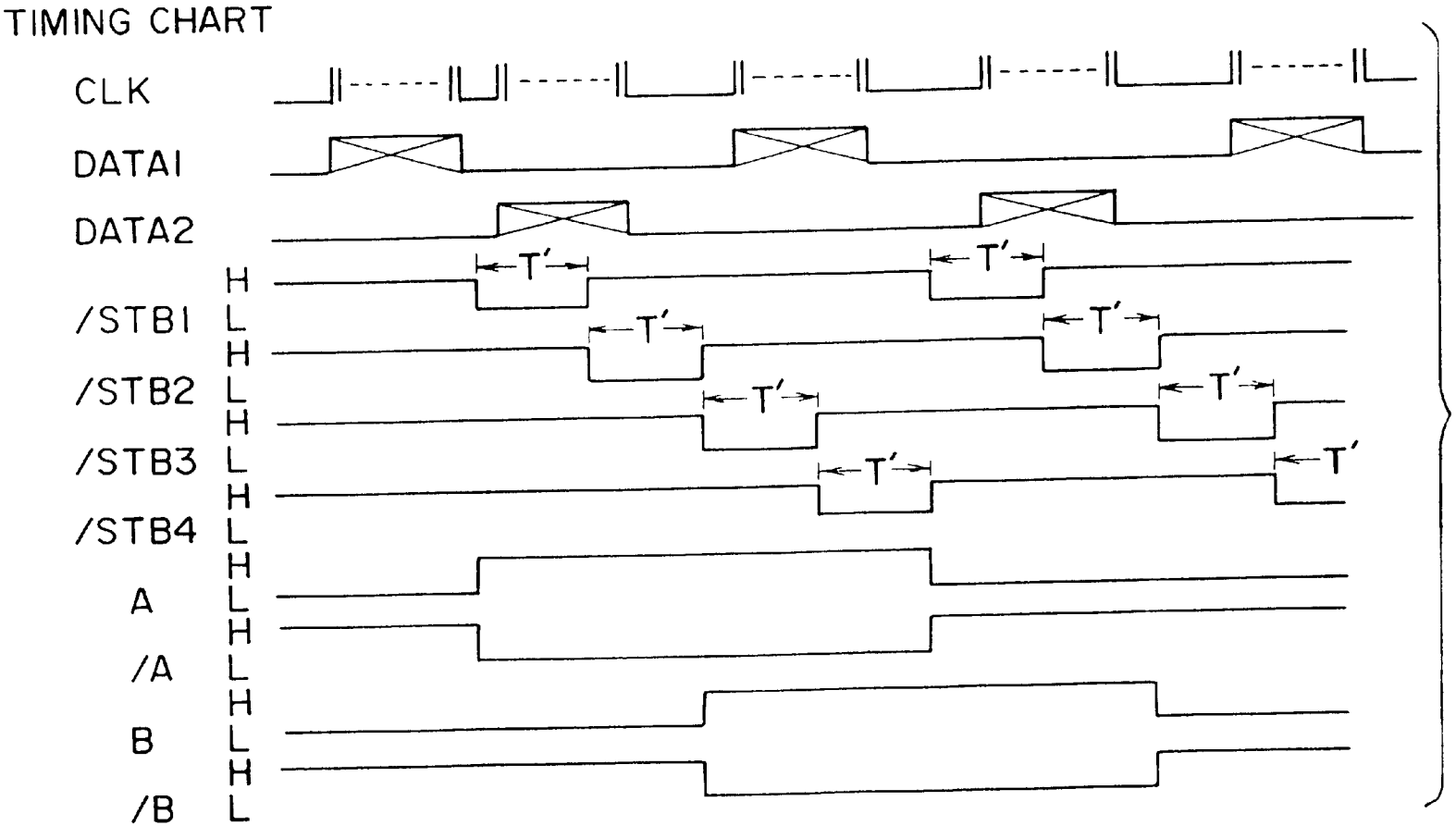
FIG. 10 is a timing chart showing the transmission of data, strobe pulses, and motor drive pulses when the voltage is relatively high, and the motor drive pulse is also changed.

It is also possible to change the width of the motor driving pulses. FIG. 10 shows such an embodiment. In FIG. 10, the pulse widths T' of the strobe /STB1 through /STB4 are substantially the same as in FIG. 6, and further, the widths of the motor drive pulses are shortened. Thus, according to the embodiment in FIG. 10, if the voltage of the battery is sufficiently high, printing speed becomes faster than usual, and the period of time required for printing one page of data can be reduced. For example, if relatively high voltage, e.g., 18 VDC, is applied to the DC connector 52, and the pulse width of the motor driving pulse as well as the strobe pulse are shortened, high speed printing can be achieved.

Further, since the connection of the external voltage source to the connector 52 is detected by means of a micro switch, if the voltage value of the external voltage source is known to be high, it is possible to control the width of pulses to be shortened upon detection of the external voltage source connected to the connector 52.

The present disclosure relates to subject matter contained in Japanese Patent Application No. HEI 5-294462, filed on Oct. 30, 1993, which is expressly incorporated herein by reference in its entirety.

What is claimed is:

1. A thermal printer having a thermal head provided with a plurality of thermal elements arranged in a line, said printer comprising:

a feeding mechanism for feeding a recording medium;

a battery;

an A/D convertor for converting a voltage V of said battery to a digital value;

a microprocessor having a strobe pulse width calculator and data representative of a heat equation stored therein, said heat equation including a relation:

$$T=Q/(V*V/R),$$

said relation relating a heat output Q of said thermal elements to said digital value representing V, a resistance value R of said thermal elements, and a strobe pulse width value T, said strobe pulse width calculator calculating said strobe pulse width according to said relation of said heat equation, said microprocessor having at least one data output for outputting printing data and at least one strobe output for outputting strobe data having said strobe pulse width;

a sensor for detecting the presence of the recording medium in the printer; and a thermal head driver connected to said plurality of thermal elements, to said at least one data output, and to said at least one strobe output, said thermal head driver driving the thermal elements in accordance with the printing data and said at least one strobe output having said strobe pulse width, said microprocessor including means for determining a feeding speed of said recording medium in accordance with said digital value of the voltage V of said battery, and means for setting said feeding mechanism to a synchronous feeding speed so that said recording medium is fed at the synchronous feeding speed corresponding to said strobe pulse width of said thermal elements.

2. The thermal printer according to claim 1, which further comprises means for feeding a recording sheet, and wherein said microprocessor varies the feeding speed of said recording sheet in accordance with said digital value so that said recording sheet is fed synchronously with a driving of said thermal elements.

3. The thermal printer according to claim 1, wherein said strobe pulse width calculator of said microprocessor calculates said strobe pulse width according to said heat equation such that said heat generated by said thermal elements is substantially constant at each operation, regardless of said voltage of said battery.

4. The thermal printer according to claim 1, which further comprises: a connector to which an external voltage source is connected; and a connection detector for detecting that said external voltage source is connected, and wherein said strobe pulse width calculator of said microprocessor calculates said strobe pulse according to said heat equation upon connection of said external voltage source.

5. The thermal printer according to claim 1, further comprising means, responsive to said voltage detected by a voltage detector, for actuating an indicator when a detected voltage is below a first predetermined value, and for terminating driving of said thermal elements when said detected voltage is below a second predetermined value.

6. The thermal printer according to claim 5, said first predetermined value corresponding to 12 volts.

7. The thermal printer according to claim 5, said indicator comprising a light emitting diode.

8. The thermal printer according to claim 5, wherein printer operation continues when said digital value is between said first predetermined value and said second predetermined value.

9. A method for controlling a thermal printer which has a thermal head provided with a plurality of thermal elements arranged in a line and a feeding mechanism for feeding a recording medium, a voltage V of a battery being applied to said thermal elements for driving said thermal elements to generate heat, said method comprising the steps of:

detecting the presence of the recording medium in the printer;

converting the voltage V of said battery to a digital value;

relating a heat output value of said thermal elements to at least said digital value, a resistance value R of said thermal elements, and a strobe pulse width value T according to a heat equation including a relation $T=Q/(V^*V/R)$;

calculating said strobe pulse width according to said heat equation;

outputting a printing data output;

outputting at least one strobe output having said strobe pulse width;

driving the thermal elements in accordance with the printing data and said at least one strobe pulse output to heat said thermal elements;

determining a feeding speed of said recording medium in accordance with said digital value of the voltage V of said battery;

setting a synchronous feeding speed; and feeding said recording medium at the synchronous feeding speed corresponding to said strobe pulse width of said thermal elements.

10. The method according to claim 9, further comprising the steps of:

detecting a voltage of said battery;

warning a user when said detected voltage is less than a first predetermined value; and terminating printer operation when said detected voltage is less than a second predetermined value, wherein said second predetermined value is less than said first predetermined value.

11. The method according to claim 10, wherein said warning to the user is provided by a light emitting diode.

12. The method according to claim 10, said first predetermined value corresponding to 12 volts.

* * * * *